US009586158B2

(12) United States Patent
Forti

(10) Patent No.: US 9,586,158 B2
(45) Date of Patent: Mar. 7, 2017

(54) TELEKINESIS LIGHT WAND

(71) Applicant: William Mark COrporation, Calremont, CA (US)

(72) Inventor: William Mark Forti, Claremont, CA (US)

(73) Assignee: WILLIAM MARK CORPORATION, Claremont, CA (US)

( * ) Notice: Subject to any disclaimer, the term of this patent is extended or adjusted under 35 U.S.C. 154(b) by 0 days.

(21) Appl. No.: 14/659,837

(22) Filed: Mar. 17, 2015

(65) Prior Publication Data

US 2016/0271511 A1 Sep. 22, 2016

(51) Int. Cl.
*A63J 5/00* (2006.01)
*F21V 33/00* (2006.01)

(52) U.S. Cl.
CPC ..... *A63J 5/00* (2013.01); *F21V 33/008* (2013.01)

(58) Field of Classification Search
CPC ..... A63J 5/00; F21V 33/008; A63H 29/00; A63H 17/28
See application file for complete search history.

(56) References Cited

U.S. PATENT DOCUMENTS

| | | | |
|---|---|---|---|
| 1,153,155 | A | 9/1915 | Fritsch |
| 1,561,721 | A | 11/1924 | Humphrey |
| 1,538,217 | A | 5/1925 | Sears |
| 1,600,554 | A | 2/1926 | Marquis |
| 2,219,831 | A | 10/1940 | Winter |
| 2,561,760 | A | 7/1945 | Stifter |
| 2,601,409 | A | 10/1948 | McArthur et al. |
| 2,469,058 | A | 5/1949 | Sullivan |
| 2,593,979 | A | 1/1952 | Calhoun |
| 2,763,958 | A | 5/1953 | Lemelson |
| 2,820,320 | A | 12/1956 | Levicy |
| 2,921,743 | A | 1/1958 | Westover et al. |
| 2,947,108 | A | 2/1958 | Dodd, Jr. et al. |
| 2,968,119 | A | 8/1958 | Glass et al. |
| 2,862,331 | A | 12/1958 | Oppenheimer |
| 3,009,670 | A | 4/1959 | Williams et al. |
| 2,958,156 | A | 7/1959 | Schmahl et al. |
| 3,030,733 | A | 1/1960 | Crawford |
| 3,087,277 | A | 4/1963 | McCook |
| 3,107,452 | A | 10/1963 | Berger |
| 3,136,460 | A | 6/1964 | Ruderian |
| 3,138,356 | A | 6/1964 | McClain |
| 3,161,988 | A | 12/1964 | Junker |
| 3,366,354 | A | 1/1968 | Sterba |
| 3,537,208 | A | 11/1970 | Martin |
| 3,589,058 | A | 6/1971 | LaBat |
| 3,600,843 | A | 8/1971 | Becker |
| 3,681,871 | A | 8/1972 | Fallo |
| 3,742,644 | A | 7/1973 | Williams |

(Continued)

FOREIGN PATENT DOCUMENTS

| | | |
|---|---|---|
| EP | 2085129 | 8/2009 |
| GB | 587621 | 5/1947 |

(Continued)

*Primary Examiner* — Peggy Neils
(74) *Attorney, Agent, or Firm* — Fish & Tsang, LLP

(57) ABSTRACT

Toy kits and methods of using toy kits including a light-up object and near-invisible tether are described herein. The light-up objects can be of any suitable size and shape, and includes a plurality of light sources disposed along its inner or outer surface(s).

7 Claims, 3 Drawing Sheets

(56) References Cited

U.S. PATENT DOCUMENTS

| | | | |
|---|---|---|---|
| 3,762,788 | A | 10/1973 | Heller |
| 3,787,013 | A | 1/1974 | McKenzie, Sr. |
| 3,802,117 | A | 4/1974 | Engelhardt |
| 3,812,611 | A | 5/1974 | Bierwiler |
| 3,844,557 | A | 10/1974 | Pompetti |
| 3,858,872 | A | 1/1975 | Summerfield et al. |
| 3,863,924 | A | 2/1975 | Gagnon |
| 3,893,256 | A | 7/1975 | Wolf et al. |
| 3,919,805 | A | 11/1975 | Stanzel |
| 3,976,297 | A | 8/1976 | Seymour |
| 3,991,512 | A | 11/1976 | Stanzel |
| 3,997,136 | A | 12/1976 | Finn et al. |
| 4,038,777 | A | 8/1977 | Schwartz |
| 4,047,323 | A | 9/1977 | Biffi |
| 4,077,588 | A | 3/1978 | Hurst |
| 4,135,711 | A | 1/1979 | Holt |
| 4,137,665 | A | 2/1979 | Bierwiler |
| 4,157,631 | A | 6/1979 | Kifferstein et al. |
| 4,159,087 | A | 6/1979 | Moomaw |
| 4,204,656 | A | 5/1980 | Seward, III |
| 4,221,351 | A | 9/1980 | Holland, Jr. |
| 4,244,136 | A | 1/1981 | Kublan |
| 4,257,186 | A | 3/1981 | Wilson |
| 4,297,808 | A | 11/1981 | D'Andrade |
| 4,457,098 | A | 7/1984 | Tsuzuki |
| 4,465,251 | A | 8/1984 | Newbold |
| 4,547,167 | A | 10/1985 | Bergmann |
| 4,552,314 | A | 11/1985 | Noguchi et al. |
| 4,664,389 | A | 5/1987 | Barclay et al. |
| 4,690,655 | A | 9/1987 | Bailey |
| 4,714,444 | A | 12/1987 | Rendel |
| 4,715,564 | A | 12/1987 | Kinn et al. |
| 4,728,311 | A | 3/1988 | Magers |
| 4,752,271 | A | 6/1988 | Reilly et al. |
| 4,802,875 | A | 2/1989 | Cunningham |
| 4,857,028 | A | 8/1989 | Pail |
| 4,891,029 | A | 1/1990 | Hutchinson |
| 4,900,286 | A | 2/1990 | Buffalo |
| 4,915,394 | A | 4/1990 | Kramer |
| 4,930,448 | A | 6/1990 | Robinson |
| 4,931,028 | A | 6/1990 | Jaeger et al. |
| 4,946,415 | A | 8/1990 | Huang |
| 4,981,456 | A | 1/1991 | Sato et al. |
| 4,982,641 | A | 1/1991 | Duhart |
| 4,992,068 | A | 2/1991 | Conrad |
| 5,011,100 | A | 4/1991 | Gersterin |
| 5,085,609 | A | 2/1992 | Haberle |
| 5,102,126 | A | 4/1992 | Nguyen |
| 5,104,344 | A | 4/1992 | Jancso, Jr. |
| 5,118,054 | A | 6/1992 | Kirschenbaum et al. |
| 5,125,864 | A | 6/1992 | Roberson et al. |
| 5,148,769 | A | 9/1992 | Zelinger |
| 5,169,353 | A | 12/1992 | Myers |
| 5,188,314 | A | 2/1993 | Peters |
| 5,194,029 | A | 3/1993 | Kinoshita |
| 5,254,077 | A | 10/1993 | Nottingham et al. |
| 5,261,849 | A | 11/1993 | French |
| 5,391,104 | A | 2/1995 | George |
| 5,429,542 | A | 7/1995 | Britt, Jr. |
| 5,468,171 | A | 11/1995 | Taylor |
| 5,474,032 | A | 12/1995 | Krietzman et al. |
| 5,505,161 | A | 4/1996 | Swendseid |
| 5,524,932 | A | 6/1996 | Kalisher |
| 5,547,413 | A | 8/1996 | Murray |
| 5,570,646 | A | 11/1996 | Mardix et al. |
| 5,603,277 | A | 2/1997 | Webb |
| 5,634,839 | A | 6/1997 | Dixon |
| 5,638,772 | A | 6/1997 | Kaufmann et al. |
| 5,709,580 | A | 1/1998 | Stanzel |
| 5,765,831 | A | 6/1998 | Huffhines |
| 5,788,286 | A | 8/1998 | Hunt |
| 5,816,877 | A | 10/1998 | Chuang |
| 5,837,913 | A | 11/1998 | Newman |
| 5,867,913 | A | 2/1999 | Pettigrew |
| 5,875,737 | A | 3/1999 | Boshears |
| 5,924,387 | A | 7/1999 | Schramer |
| 6,016,771 | A | 1/2000 | Baiera et al. |
| 6,019,661 | A | 2/2000 | Simpkins |
| 6,039,625 | A | 3/2000 | Wang |
| 6,044,581 | A | 4/2000 | Shipman et al. |
| 6,076,758 | A | 6/2000 | Kieves et al. |
| 6,135,388 | A | 10/2000 | Hostetter |
| 6,142,845 | A | 11/2000 | Feldman |
| 6,192,215 | B1 | 2/2001 | Wang |
| 6,250,526 | B1 | 6/2001 | Bess |
| 6,283,816 | B1 | 9/2001 | Pascual |
| 6,302,759 | B1 | 10/2001 | Hsich |
| 6,311,425 | B1 | 11/2001 | Capps |
| 6,314,913 | B1 | 11/2001 | Lettau et al. |
| 6,318,300 | B1 | 11/2001 | Renforth et al. |
| 6,327,801 | B1 | 12/2001 | Witkowski |
| 6,357,160 | B1 | 3/2002 | Hackman et al. |
| 6,361,395 | B1 | 3/2002 | Pacza |
| 6,443,397 | B1 | 9/2002 | Morris |
| 6,491,565 | B1 | 12/2002 | McCullough |
| 6,520,824 | B1 | 2/2003 | Caroselli |
| 6,572,428 | B1 | 6/2003 | Weiser et al. |
| 6,572,482 | B1 | 6/2003 | Lewis, Jr. |
| 6,581,879 | B2 | 6/2003 | Bellacera |
| 6,582,272 | B1 | 6/2003 | Nelson |
| 6,620,018 | B1 | 9/2003 | Chao et al. |
| 6,631,811 | B2 | 10/2003 | Komar et al. |
| 6,663,460 | B1 | 12/2003 | Nelson |
| 6,684,819 | B1 | 2/2004 | Locke |
| 6,688,260 | B2 | 2/2004 | Morrison |
| 6,688,936 | B2 | 2/2004 | Davis |
| 6,748,890 | B1 | 6/2004 | Norment |
| 6,752,682 | B1 | 6/2004 | Ferrell |
| 6,845,737 | B1 | 1/2005 | Austin |
| 6,848,647 | B2 | 2/2005 | Albrecht |
| 6,877,692 | B2 | 4/2005 | Liu |
| 6,907,688 | B2 | 6/2005 | Brint |
| 6,938,275 | B1 | 9/2005 | Fried |
| 6,945,841 | B2 | 9/2005 | Becker et al. |
| 6,962,309 | B1 | 11/2005 | Chang |
| 6,988,694 | B2 | 1/2006 | Barrs et al. |
| 6,991,510 | B2 | 1/2006 | Nan |
| 7,044,084 | B2 | 5/2006 | Ritchey |
| 7,104,861 | B2 | 9/2006 | Kannahele et al. |
| 7,246,574 | B2 | 7/2007 | Renforth |
| 7,311,578 | B2 | 12/2007 | Stanley et al. |
| 7,335,000 | B2 | 2/2008 | Ferguson |
| 7,356,390 | B2 | 4/2008 | Knoblach et al. |
| 7,493,723 | B2 | 2/2009 | Hess |
| 7,513,220 | B2 | 4/2009 | Ragonetti et al. |
| 7,536,823 | B2 | 5/2009 | Brint |
| 7,601,046 | B2 | 10/2009 | Chang |
| 7,602,077 | B2 | 10/2009 | Ferguson |
| 7,780,498 | B1 | 8/2010 | Caspi et al. |
| 8,142,295 | B2 * | 3/2012 | Mesika ..... A63H 33/22 446/47 |
| 8,398,449 | B2 * | 3/2013 | Forti ..... A63H 7/02 244/153 R |
| 2001/0034176 | A1 | 10/2001 | Deliu |
| 2002/0111106 | A1 | 8/2002 | Bollman |
| 2002/0142699 | A1 | 10/2002 | Davis |
| 2002/0173216 | A1 | 11/2002 | Abel |
| 2003/0034955 | A1 | 2/2003 | Gilder et al. |
| 2003/0045202 | A1 | 3/2003 | Komar et al. |
| 2003/0124950 | A1 | 7/2003 | Turner |
| 2004/0116040 | A1 | 6/2004 | Mulvihill et al. |
| 2005/0085156 | A1 | 4/2005 | Ng |
| 2006/0054105 | A1 | 3/2006 | Renforth et al. |
| 2006/0054106 | A1 | 3/2006 | Renforth |
| 2006/0157622 | A1 | 7/2006 | Johnston et al. |
| 2006/0183396 | A1 | 8/2006 | Kanahele et al. |
| 2006/0194504 | A1 | 8/2006 | Ragonetti et al. |
| 2006/0217027 | A1 | 9/2006 | Martuccio |
| 2006/0266299 | A1 | 11/2006 | D'Antonio |
| 2006/0292959 | A1 | 12/2006 | Greenwald et al. |
| 2007/0063099 | A1 | 3/2007 | Holloman, Jr. |
| 2007/0119384 | A1 | 5/2007 | Ritchey |
| 2007/0161322 | A1 | 7/2007 | Carmon |
| 2007/0228228 | A1 | 10/2007 | Korbonski |

(56) References Cited

U.S. PATENT DOCUMENTS

| | | | | |
|---|---|---|---|---|
| 2007/0283899 | A1 | 12/2007 | Genitrini | |
| 2008/0076322 | A1 | 3/2008 | Phillips | |
| 2008/0085655 | A1 | 4/2008 | Boise | |
| 2008/0085656 | A1 | 4/2008 | Boise | |
| 2008/0087762 | A1 | 4/2008 | Holloman et al. | |
| 2008/0230658 | A1 | 9/2008 | Waits et al. | |
| 2009/0176433 | A1 | 7/2009 | Forti | |
| 2009/0176434 | A1 | 7/2009 | Forti | |
| 2009/0205580 | A1 | 8/2009 | Tiefel | |
| 2012/0208650 | A1* | 8/2012 | Zealer | A63J 5/02 472/68 |

FOREIGN PATENT DOCUMENTS

| | | |
|---|---|---|
| JP | 2002306857 | 10/2002 |
| JP | 2002309202 | 10/2002 |
| JP | 2004261620 | 9/2004 |
| JP | 2006035562 | 2/2006 |

* cited by examiner

Figure 2
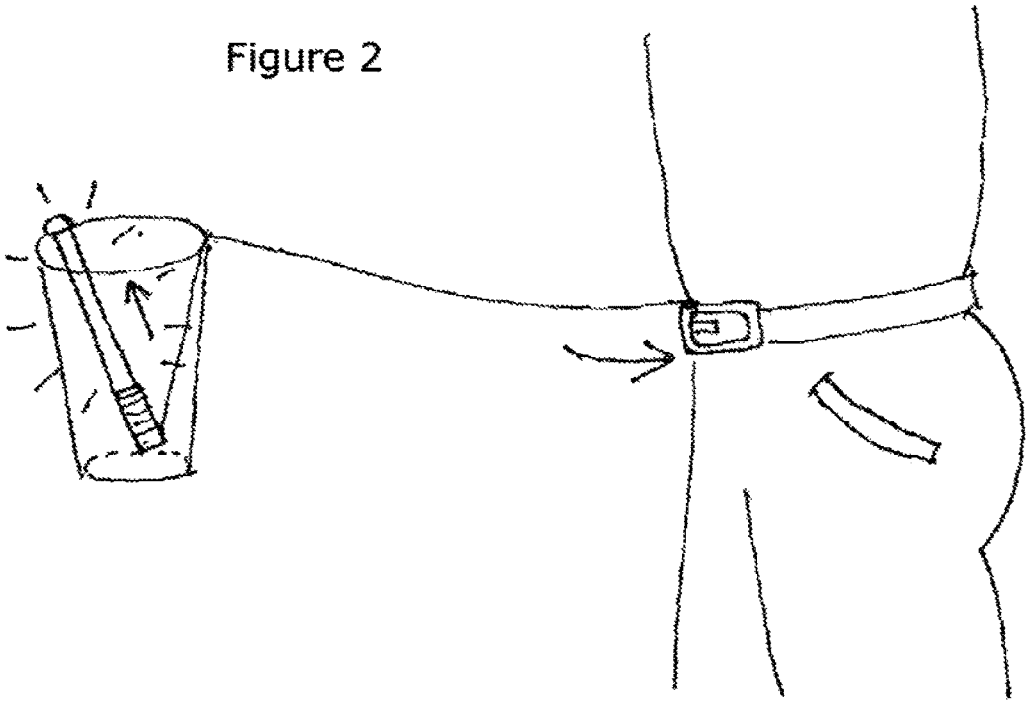
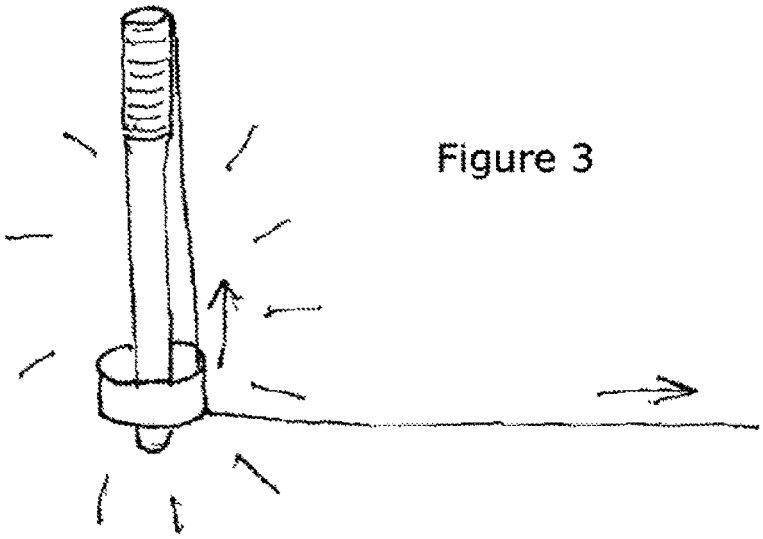
Figure 3

TELEKINESIS LIGHT WAND

FIELD OF THE INVENTION

The field of the invention is toys, more specifically light-up toy objects that appears to operate via telekinesis.

BACKGROUND

Both adults and children have long been fascinated by magic tricks in which the magician appears to move objects by the power of the mind (a.k.a. telekinesis). Such tricks are often performed using an "invisible thread," which is typically a very thin and strong black thread that is nearly invisible to the unaided eye except under certain lighting conditions.

However, it has not been appreciated that such invisible threads could be used to create a more complex and impressive illusion of manipulating lighting and movement of objects using the power of the mind.

Thus, there is still a need for improved toys that appear to operate via telekinesis.

SUMMARY OF THE INVENTION

The inventive subject matter includes a kit for performing telekinesis tricks. The kit may include a light wand, orb, or any other commercially suitable light-up object having one or more LEDs capable of producing a variety of light effects such as pulsing, dimming, brightening and color shifting. The light-up object could include a hidden or exposed switch that enables a user to initiate a light sequence via the LEDs. For example, once the switch is activated, the light sequence can begin with an off period followed by one or more periods of pulsating lights, flickering lights, or color shifting/changing lights. Where the switch is hidden, the light sequence could appear to have been activated by the user's mental concentration via the use of a tether.

The kit can include several lengths of tether that is nearly invisible to the unaided eye in various environments, for example, a black nylon or Kevlar thread. Additionally or alternatively, the kit can include one or more removable caps that fits over a portion of the light-up object, or within an end-opening of the light-up object. Preferably, the cap (s) can be concealed or "palmed" by the user, allowing the user to engage the switch while others cannot. Additionally or alternatively, the kit can include one or more objects having openings (e.g., rings) that are sized and dimensioned to receive at least a portion of the light-up object (e.g., a ring through which the light-up object can pass through).

Viewed from another perspective, the inventive subject matter includes a toy kit including a light-up object that is open (e.g., tube), partially closed (e.g., tube closed on one end) or closed (e.g., tube closed on both ends, ball-shaped), and has a lumen where one or more light sources are disposed. As used herein, the term "lumen" is used not only to refer to an inner space of a tube, but also to refer to any internal unfilled space of an object.

The kit can also include a switch (e.g., a push-button switch) that is electrically coupled to the light sources and configured to create a lighting effect via the light sources upon activation. The kit can also include a near-invisible tether that can be coupled at one end to the switch, and coupled at another end to a user such that a movement of the user can create the illusion that a lighting effect was activated via the power of the user's mind.

BRIEF DESCRIPTION

FIG. 2 illustrates a kit having a length of tether attached to a user's belt.

FIG. 3 illustrates another kit of the inventive subject matter including a ring-shaped object.

DETAILED DESCRIPTION

Figure 1:
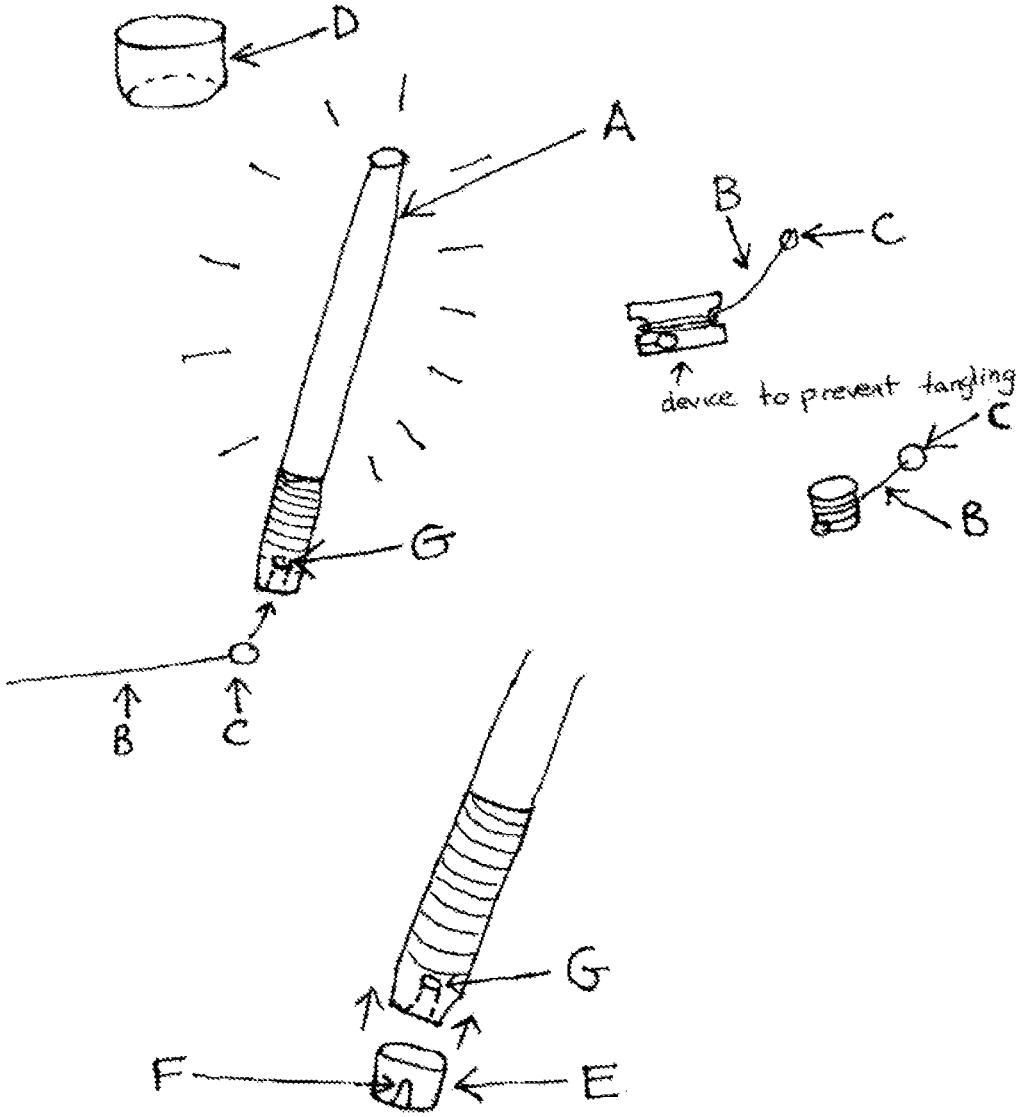
FIG. 1 illustrates a kit of the inventive subject matter.

FIG. 1 illustrates a kit of the inventive subject matter comprising a plastic light-up object (A) containing one or more LEDs therein, a precut length of the near-invisible tether (B) having a small piece of low-tack adhesive (C) on one or both ends, and one or more ring-shaped objects (D) of a light-weight material that allow for greater a greater variety of magic tricks to be performed. A cap (E) may be included that fits over one end of the light-up object and can be easily removed. The cap may have an indentation (F) that allows a user to activate the hidden switch (G) in a manner not otherwise accessible.

Plastic light-up object (A) here is configured as a wand that is approximately 20 cm long (e.g., between 15 and 25 cm long). In other embodiments, the light-up object could be made of any suitable material and comprise any suitable shape and dimensions.

The length of near-invisible tether can be attached to the light-up object or the removable cap at one end, and to a user's body or his clothing (e.g., shift, pants, belt or other accessory) at another end. Preferably several lengths of near-invisible tether are included in the kit incase one of the lengths get tangled or breaks. To prevent tangling of the lengths of tether, they can be wound around a rod or other object and kept in place.

One contemplated method for performing a simple telekinesis trick using a kit of the inventive subject matter is shown in FIG. 2. One end of a length of near-invisible tether is attached to a cap using a small piece of putty (or other attaching mechanism), and the cap is placed on the end of a light wand such that pushing the cap in could trigger a switch of the light wand. The other end of the tether can be attached to the user's belt, zipper, pants or shirt using a second small piece of putty (or other attaching mechanism). The putty could be attached to a cardboard card for ease of unwinding, and the card could simply be put inside the user's pants. The light wand is placed upright or near-upright in a clear drinking glass, vase, bottle, or other container. Through subtle body movements such as moving the hips slowly backwards and the near-invisible tether, the user appears to mysteriously move the light wand and makes the wand begin to glow and pulsate with light using the power of his concentration until the user's concentration is apparently lost and the light fades and the object descends.

Where ring-shaped objects are provided, the rings may be approximately 2 cm to 5 cm in diameter and may be made of shiny foil or metallic plastic to make them appear heavier than they are, thereby enhancing the illusion of telekinesis. One contemplated method for performing a simple telekinesis trick using a kit of the inventive subject matter having ring-shaped objects is shown in FIG. 3. Initial setup can be performed as in FIG. 2, wherein the tether is attached to a cap, and the cap is placed on an end of a light-up wand such that pushing the cap in could trigger a switch of the light wand. Then a ring is placed over the end of the light wand opposite the cap. With the ring supported by the tether, the user can make the ring move up and down the light wand using subtle body movements, thereby creating the illusion that the ring moves by the power of the user's mind. The ring could also move up the wand inside the container shown in FIG. 2.

Figure 4:
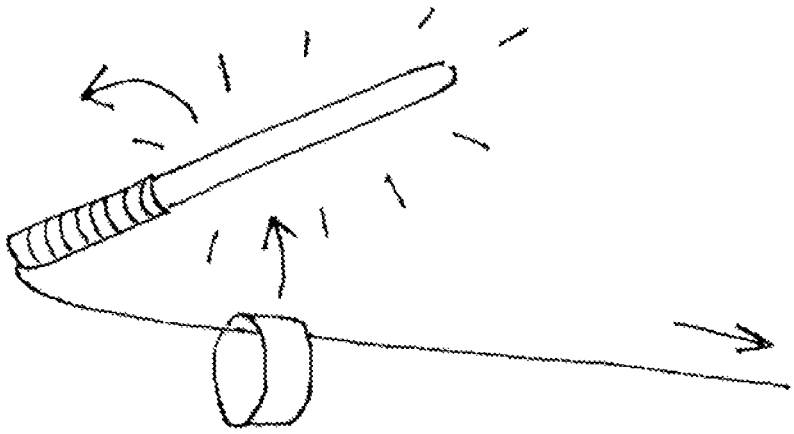
FIG. 4 illustrates a ring-shaped object moved around a length of tether.
Figure 5:
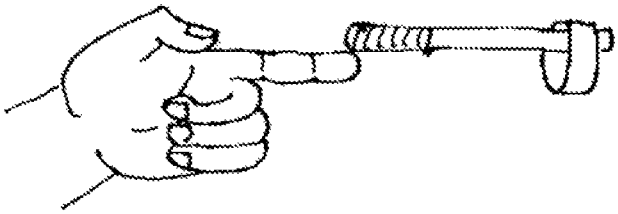
FIG. 5 illustrates a light-up object appearing to balance on a user's fingertip.

As shown in FIG. 4, the ring could be threaded onto the wand and tether, then set on a flat surface and made to move toward the wand as the wand lights up. Then both objects could "fly" into the user's hand in a complex and mysterious motion. Of course, other non-ring-shaped objects such as paper, coins, straws, cards, paperclips, pens, etc. could also be moved with the light wand. An additional method could involve creating the illusion of an impossible balancing feat in which the wand and object are suspended on or near a finger or other object as if suspended by an unseen force (see FIG. 5).

The light-up object could be made of a plastic or other lightweight material, or any other suitable material through which light could at least partially travel through. Additionally or alternatively, the light-up object need not be of an oblong or regular shape (e.g., a wand), and its length may be shorter or longer than 15-25 cm. In some embodiments, the light wand can be the 4-6 inches long (e.g., the size of an average pen), while in other embodiments, the light wand can be 10-12 inches long. Other embodiments of the light wand allow for lengths of 6-8 inches, 8-10 inches, 12-14 inches, 14-16 inches, and so forth.

The shape of the light-up object could approximate any suitable object. For example, the light-up object could be shaped as an orb, a dagger, a pen, a wizard, a witch, or any other suitable object. The LEDs in the light wand may be any color, number and configuration. Lighting effects may include, but are not limited to, turning LEDs on and off, pulsing, dimming, brightening, and color shifting. While the kits described herein are generally directed towards kits having LED light source(s), it should be appreciated that any other light source could be included, including for example, neon light emitting tubes or bulbs, or incandescent tubes or bulbs.

In some embodiments, the light sources can react or create different lighting effects based on a movement of the light-up object (corresponding to the user's movement). For example, an accelerometer, magnetometer or other sensor can be included in the light-up object, and patterns of pulsing, dimming, etc. could depend on feedback from the sensor.

The light-up object can be made to have different lengths, widths, cross-sectional shapes, weights, sizes, or any other characteristics. Furthermore, the light-up object can be made from different materials to achieve different design features. In some embodiments, it is desirable to create the object to be lightweight (e.g., made of a light-weight plastic) such that it can be very easily moved by the near-invisible tether, which in some situations can enhance the illusion. To create a heavier light-up object, the material used to create the wand can be created from specific materials, such as a metal (e.g., steel) or ceramic (e.g., glass, porcelain, fired clay, etc.).

Where a cap is included, the cap could be sized and dimensioned to fit over a portion of the near-invisible tether to fasten the tether to the light-up object. Additionally or alternatively, the cap can include a connection point to which the near invisible tether could attach. The connection point could comprise a screw, a clip, or any other suitable fastener.

The cap may be made of plastic or any other (preferably lightweight) material. Its size should be sufficient to fit over the end of the light wand and not be noticed if it is removed from the wand. The cap can be designed to pressure fit into the lumen of the wand or around an end of the want, or it can snap in by a detent or similar mechanism (e.g., similar to how many pen caps fit onto pens). Additionally or alternatively, the cap can be designed to fit flush against an end of the wand so that it is very difficult to see that the car has been put on at all.

The ring-shaped object(s) may be made of plastic, holographic foil, metals, alloys, paper or any other (preferably lightweight) material. The ring-shaped object(s) may be of any size suitable to fit around at least a portion of the light wand, and may or may not have a circular cross-section. In some contemplated embodiments, any lightweight objects may be used or included.

In some embodiments, some or all of the rings included in a kit may be decorated to appear as a heavier material, enhancing the illusion of the floating object that is created.

When performing telekinesis tricks, the wand may be placed in, on or around any container or other object. For example, the wand can be placed in a drinking glass or other (preferably clear) container, or can be placed on a table or a floor.

The lengths of near-invisible tether may be of any length and number. The tether may be fabricated from numerous materials so long as it/they are near-invisible to the unaided eye in various environments (e.g., indoors, outdoors, bright, dark), and thickness may vary so long as such tethers have sufficient tensile strength to carry the weight of the light-up object without breaking. The lengths could be stored by individually wrapping them around cards, cylinders, tubes, etc. to prevent tangling of the lengths.

The lengths of tether in some kits will be between 6 and 25 inches long, between 10 and 20 inches long, or event between 12 and 18 inches long. In some kits the lengths of tether can be shorter or greater, for example, between 1 and 10 inches long, between 10 and 30 inches long, between 25 and 40 inches long, or even greater.

The adhesive used to attach the tether may be putty, tape, glue or any other low-tack adhesive. Where a cap is pressure fit at least partially into the lumen of the wand (or around an end portion of the wand), the cap can hold the tether in place between the cap and wand.

The tether may removably attach to anywhere on or worn on the user's body, including but not limited to a user's belt, clothing or skin. The tether may also attach to another object or body. Some suitable tethers, low-tack adhesives compositions and methods are described in U.S. Pat. No. 8,398,449 and U.S. Pat. No. 8,118,634, which are incorporated by reference in their entirety.

It should be appreciated that a clip, mechanical fastener or tying/connecting mechanism (e.g., a knot, a loop) could be used in place of an adhesive in some embodiments.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as", etc.) provided with respect to certain embodiments herein is intended merely to better illuminate the invention and does not pose a limitation on the scope of the invention otherwise claimed. No language in the specification should be construed as indicating any non-claimed element essential to the practice of the invention.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts in this application. The inventive subject matter, therefore, is not to be restricted except in the spirit of the appended claims. Moreover, in interpreting both the specification and the claims, all terms should be interpreted in the broadest possible manner consistent with the context.

The invention claimed is:

1. A toy kit, comprising:

a first object shaped as a wand comprising a first end, a second end, an outer surface and an inner surface defining a lumen;

one or more light sources disposed along the inner surface of the first object;

a switch electrically coupled to the one or more light sources and configured to, upon activation, create a lighting effect via the one or more light sources;

a ring-shaped object sized and configured to fit around at least a portion of the first object and a near-invisible tether having a first end and a second end, wherein the first end of the tether is configured to couple to and optionally activate the switch, and wherein the second end of the tether comprises a low-tack adhesive sized and dimensioned to couple with at least one of a user and an item worn by a user to assist in producing a telekinesis effect.

2. The toy kit of claim 1, wherein the lighting effect comprises at least one of a dimming light, a brightening light, a steady light, a pulsing light, and a color shifting light.

3. The toy kit of claim 1, wherein the first end of the tether comprises a low-tack adhesive.

4. The toy kit of claim 1, further comprising a cap that is configured to removably couple with the first end of the first object and the near-invisible tether.

5. The toy kit of claim 4, wherein the switch is disposed within the lumen, and the cap is sized and dimensioned to contact and activate the switch when removably coupled with the first end of the first object.

6. The toy kit of claim 1, further comprising at least a second object sized and dimensioned to receive at least the second end of the first object.

7. A method of performing a telekinesis trick comprising the steps of:

obtaining a first object shaped as a wand having a first end, a second end, an outer surface, an inner surface, a plurality of light sources is disposed along the inner surface; and a switch electrically coupled to the plurality of light sources;

obtaining a near-invisible tether having a first end and a second end;

attaching the first end of the tether to the switch or a cap that contacts the switch;

attaching the second end of the tether using a low-tack adhesive to a user or an item worn by the user such that a movement by the user activates the switch and creates a lighting effect via the plurality of light sources; and placing a ring-shaped object around the tether or the first object.

* * * * *